US008551932B2

(12) United States Patent
Barger et al.

(10) Patent No.: US 8,551,932 B2
(45) **Date of Patent: *Oct. 8, 2013**

(54) LIQUID HARD SURFACE CLEANING COMPOSITION

(75) Inventors: Bruce Barger, Cincinnati, OH (US); Jacqueline Marie Duderstadt, Cincinnati, OH (US); Denis Alfred Gonzales, Brussels (BE); Stefano Scialla, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/567,930

(22) Filed: Sep. 28, 2009

(65) Prior Publication Data

US 2010/0081605 A1 Apr. 1, 2010

Related U.S. Application Data

(60) Provisional application No. 61/101,192, filed on Sep. 30, 2008.

(51) Int. Cl.
*C11D 3/28* (2006.01)

(52) U.S. Cl.
USPC ..... 510/238; 510/322

(58) Field of Classification Search
USPC ..... 510/322, 238
See application file for complete search history.

(56) References Cited

U.S. PATENT DOCUMENTS

| | | | | |
|---|---|---|---|---|
| 1,621,906 | A | | 3/1927 | Schless |
| 2,082,275 | A | | 6/1937 | Daimler et al. |
| 2,084,632 | A | | 6/1937 | Ellis |
| 2,255,082 | A | | 9/1941 | Orthner et al. |
| 2,438,091 | A | | 3/1948 | Lynch |
| 2,528,378 | A | | 10/1950 | Mannheimer |
| 2,658,072 | A | | 11/1953 | Kosmin |
| 2,702,279 | A | | 2/1955 | Funderburk et al. |
| 3,070,510 | A | | 12/1962 | Cooley et al. |
| 1,082,179 | A | | 6/1971 | Smeets |
| 3,812,044 | A | | 5/1974 | Connor et al. |
| 3,915,903 | A | | 10/1975 | Wise |
| 3,929,678 | A | | 12/1975 | Laughlin et al. |
| 3,985,668 | A | | 10/1976 | Hartman |
| 4,025,444 | A | | 5/1977 | Murphy et al. |
| 4,051,056 | A | | 9/1977 | Hartman |
| 4,088,620 | A | | 5/1978 | Nihongi et al. |
| 4,102,992 | A | | 7/1978 | Davis |
| 4,240,919 | A | | 12/1980 | Chapman |
| 4,298,490 | A | | 11/1981 | Lange et al. |
| 4,309,316 | A | | 1/1982 | Lange et al. |
| 4,473,611 | A | | 9/1984 | Haq |
| 4,481,126 | A | * | 11/1984 | Trinh et al. ..... 134/4 |
| 4,537,604 | A | | 8/1985 | Dawson |
| 4,565,644 | A | | 1/1986 | Smith et al. |
| 4,565,647 | A | | 1/1986 | Llenado |
| 4,581,385 | A | | 4/1986 | Smith et al. |
| 4,657,692 | A | | 4/1987 | Choy et al. |
| 4,663,069 | A | | 5/1987 | Llenado |
| 4,676,920 | A | | 6/1987 | Culshaw |
| 4,704,233 | A | | 11/1987 | Hartman et al. |
| 4,767,563 | A | | 8/1988 | De Buzzaccarini |
| 4,772,425 | A | | 9/1988 | Chirash et al. |
| 4,842,763 | A | | 6/1989 | Troger et al. |
| 4,906,396 | A | | 3/1990 | Falholt et al. |
| 5,287,207 | A | | 2/1994 | Mulkens et al. |
| 5,500,451 | A | | 3/1996 | Goldman et al. |
| 5,776,872 | A | | 7/1998 | Giret et al. |
| 5,776,878 | A | | 7/1998 | Theon |
| 5,798,505 | A | | 8/1998 | Lee |
| 5,821,214 | A | | 10/1998 | Weibel |
| 5,830,445 | A | | 11/1998 | Bouillon et al. |
| 5,883,062 | A | | 3/1999 | Addison et al. |
| 5,898,026 | A | | 4/1999 | Yianakopoulos et al. |
| 5,906,973 | A | | 5/1999 | Ouzounis et al. |
| 6,008,181 | A | | 12/1999 | Cripe et al. |
| 6,020,303 | A | | 2/2000 | Cripe et al. |
| 6,060,443 | A | | 5/2000 | Cripe et al. |
| 6,080,707 | A | | 6/2000 | Glenn et al. |
| 6,132,212 | A | | 10/2000 | Horiguchi et al. |
| 6,221,829 | B1 | | 4/2001 | Symes et al. |
| 6,242,405 | B1 | | 6/2001 | Lykke et al. |
| 2,305,434 | A1 | | 7/2001 | Luciani et al. |
| 6,265,363 | B1 | | 7/2001 | Viscovitz |

(Continued)

FOREIGN PATENT DOCUMENTS

| | | | |
|---|---|---|---|
| DE | 24 10 425 | A1 | 10/1974 |
| DE | 10 2004 03877 | A1 | 8/2005 |

(Continued)

OTHER PUBLICATIONS

PCT International Search Report, 4 pages, Mailed Sep. 12, 2009.

ASTM Designation: F1877-05 Jun. 10, 2009; Standard Practice for Characterization of Particles; 14 pages; chapter 11.3.6; Section 11.3.2.

International Standard; ISO 9276-6:2008(E) section 8.2; section 7; Representation of results of particle size analysis—Part 6: Descriptive and quantitative representation of particle shape and morphology.

"Vegetable Ivory", W.P. Armstrong, (http://waynesword.palomar.edu/pljan99.htm).

"Phytelephas", Wikipedia.org (http://en.wikipedia.org/wiki/Phytelephas).

(Continued)

*Primary Examiner* — Mark Eashoo
*Assistant Examiner* — M. Reza Asdjodi
(74) *Attorney, Agent, or Firm* — John T. Dipre; Amy I. Ahn-Roll

(57) ABSTRACT

A liquid hard surface cleaning composition includes melamine foam fibers. In one embodiment the composition has a pH of from about 7 to about 12. In another embodiment, the composition comprises less than about 200 ppm of formaldehyde in solution, per about 1% by weight of melamine foam fibers present in the composition, after 7 days of storage at 50 C.

13 Claims, No Drawings

(56) References Cited

U.S. PATENT DOCUMENTS

| | | | | |
|---|---|---|---|---|
| 6,274,540 | B1 | 8/2001 | Scheibel et al. | |
| 6,299,746 | B1 | 10/2001 | Conte et al. | |
| 6,306,817 | B1 | 10/2001 | Kott et al. | |
| 6,359,031 | B1 | 3/2002 | Lykke et al. | |
| 6,369,121 | B1 | 4/2002 | Catalfamo et al. | |
| 6,444,716 | B1 | 9/2002 | Hird et al. | |
| 6,514,926 | B1 | 2/2003 | Kott et al. | |
| 6,525,233 | B1 | 2/2003 | Connor et al. | |
| 6,537,957 | B1 | 3/2003 | Cardola et al. | |
| 6,566,319 | B1 | 5/2003 | Scheibel et al. | |
| 6,583,096 | B1 | 6/2003 | Kott et al. | |
| 6,593,285 | B1 | 7/2003 | Scheibel et al. | |
| 6,602,840 | B1 | 8/2003 | Scheibel et al. | |
| 6,699,963 | B2 | 3/2004 | Noda et al. | |
| 6,749,066 | B2 * | 6/2004 | Bergman | 206/524.4 |
| 6,759,377 | B2 | 7/2004 | Hackenthal et al. | |
| 6,767,878 | B1 | 7/2004 | Paye et al. | |
| 6,808,759 | B1 | 10/2004 | Okumura et al. | |
| 6,858,216 | B2 | 2/2005 | Schulze zur Wiesche et al. | |
| 1,797,947 | A1 | 6/2007 | Anastasiou et al. | |
| 2,384,243 | A1 | 12/2007 | Cook et al. | |
| 7,393,820 | B2 | 7/2008 | Soldanski et al. | |
| 7,713,921 | B2 | 5/2010 | Boutique et al. | |
| 7,994,111 | B2 | 8/2011 | Caggioni et al. | |
| 2002/0137647 | A1 | 9/2002 | Hackenthal et al. | |
| 2002/0166832 | A1 | 11/2002 | Silud et al. | |
| 2002/0173243 | A1 | 11/2002 | Costas et al. | |
| 2003/0176633 | A1 | 9/2003 | Noda et al. | |
| 2003/0215417 | A1 | 11/2003 | Uchiyama et al. | |
| 2004/0216388 | A1 | 11/2004 | Mathur et al. | |
| 2004/0266645 | A1 | 12/2004 | Albrecht et al. | |
| 2005/0065056 | A1 | 3/2005 | Cook et al. | |
| 2005/0130873 | A1 | 6/2005 | Cheung et al. | |
| 2005/0170979 | A1 | 8/2005 | Massaro et al. | |
| 2005/0201965 | A1 | 9/2005 | Kuhlman et al. | |
| 2006/0011885 | A1 | 1/2006 | Christmas et al. | |
| 2006/0094635 | A1 | 5/2006 | Pereira | |
| 2006/0177488 | A1 | 8/2006 | Caruso et al. | |
| 2007/0006391 | A1 * | 1/2007 | Ghosh et al. | 8/115.51 |
| 2007/0010415 | A1 | 1/2007 | Kinscherf et al. | |
| 2007/0041927 | A1 | 2/2007 | Blaeser et al. | |
| 2007/0043147 | A1 | 2/2007 | Higgins et al. | |
| 2007/0135645 | A1 | 6/2007 | Ignatyev et al. | |
| 2007/0167345 | A1 | 7/2007 | Soldanski et al. | |
| 2007/0191256 | A1 * | 8/2007 | Fossum et al. | 510/515 |
| 2007/0270730 | A1 | 11/2007 | Rische et al. | |
| 2008/0013972 | A1 | 1/2008 | De Almeida et al. | |
| 2008/0108714 | A1 | 5/2008 | Swazey et al. | |
| 2008/0149137 | A1 * | 6/2008 | Steinbrenner et al. | 134/8 |
| 2008/0248144 | A1 | 10/2008 | Guenter et al. | |
| 2009/0176935 | A1 | 7/2009 | Boeckh et al. | |
| 2009/0253816 | A1 | 10/2009 | Nascimento et al. | |
| 2009/0291306 | A1 | 11/2009 | Quadbeck-Seeger | |
| 2009/0325837 | A1 | 12/2009 | Mundschau et al. | |
| 2010/0081604 | A1 | 4/2010 | Barger et al. | |
| 2010/0081606 | A1 | 4/2010 | Barger et al. | |
| 2010/0197553 | A1 | 8/2010 | Barnabas et al. | |
| 2011/0021398 | A1 | 1/2011 | Allef et al. | |
| 2011/0039744 | A1 | 2/2011 | Heath et al. | |
| 2011/0150787 | A1 | 6/2011 | Gonzales et al. | |
| 2011/0150788 | A1 | 6/2011 | Gonzales et al. | |
| 2011/0150949 | A1 | 6/2011 | Gonzales et al. | |
| 2011/0150950 | A1 | 6/2011 | Gonzales et al. | |
| 2011/0150951 | A1 | 6/2011 | Gonzales et al. | |
| 2011/0178196 | A1 | 7/2011 | Steinke et al. | |
| 2011/0189414 | A1 | 8/2011 | Whitehouse | |
| 2011/0262371 | A1 | 10/2011 | Deleersnyder et al. | |
| 2011/0262504 | A1 | 10/2011 | Deleersnyder et al. | |
| 2011/0287105 | A1 | 11/2011 | Gittleman | |
| 2012/0029519 | A1 | 2/2012 | Sengun et al. | |
| 2012/0066851 | A1 | 3/2012 | Gonzales et al. | |
| 2012/0071378 | A1 | 3/2012 | Gonzales et al. | |
| 2012/0071379 | A1 | 3/2012 | Gonzales et al. | |
| 2012/0071380 | A1 | 3/2012 | Gonzales et al. | |
| 2012/0071383 | A1 | 3/2012 | Perez-Prat Vinuesa et al. | |
| 2012/0202730 | A1 | 8/2012 | Allef et al. | |

FOREIGN PATENT DOCUMENTS

| | | | |
|---|---|---|---|
| DE | 10 2005 023801 | A1 | 11/2006 |
| EP | 1 136 063 | A2 | 9/2001 |
| EP | 1 460 125 | A1 | 9/2004 |
| EP | 1797947 | A2 | 6/2007 |
| GB | 2 001 099 | A | 1/1979 |
| GB | 2 126 999 | A | 4/1984 |
| GB | 2 145 729 | A | 4/1985 |
| GB | 2 305 434 | A | 4/1997 |
| JP | 59192526 | A | 10/1984 |
| JP | 10025239 | A | 1/1998 |
| JP | 2005 296822 | * | 10/2005 |
| JP | 2005 296822 | A | 10/2005 |
| JP | 2007 077311 | A | 3/2007 |
| JP | 2009 160717 | A | 7/2009 |
| WO | WO 91/14420 | A1 | 10/1991 |
| WO | WO 99/05084 | A1 | 2/1999 |
| WO | WO 99/52500 | A1 | 10/1999 |
| WO | WO 01/21499 | A1 | 3/2001 |
| WO | WO 01/31110 | A1 | 5/2001 |
| WO | WO 02/38720 | A1 | 5/2002 |
| WO | WO 2004/071483 | A1 | 8/2004 |
| WO | WO 2007/091223 | A1 | 8/2007 |
| WO | WO 2008/109270 | A1 | 9/2008 |

OTHER PUBLICATIONS

U.S. Appl. No. 13/517,837, filed Jun. 14, 2012, Gonzales, et al.
U.S. Appl. No. 13/517,728, filed Jun. 14, 2012, Gonzales, et al.
U.S. Appl. No. 13/526,592, filed Jun. 19, 2012, Gonzales, et al.
U.S. Appl. No. 13/526,596, filed Jun. 19, 2012, Gonzales, et al.
U.S. Appl. No. 13/517,746, filed Jun. 14, 2012, Gonzales, et al.
U.S. Appl. No. 13/526,605, filed Jun. 19, 2012, Gonzales, et al.
U.S. Appl. No. 13/526,613, filed Jun. 19, 2012, Gonzales, et al.
U.S. Appl. No. 13/517,762, filed Jun. 14, 2012, Perez-Prat Vinuesa, et al.
U.S. Appl. No. 13/621,858, filed Sep. 18, 2012, Gonzales, et al.
U.S. Appl. No. 13/621,860, filed Sep. 18, 2012, Perez-Prat Vinuesa, et al.

* cited by examiner

LIQUID HARD SURFACE CLEANING COMPOSITION

CROSS REFERENCE TO RELATED APPLICATION(S)

This application claims the benefit of U.S. Provisional Application No. 60/101,192, filed on Sep. 30, 2008.

FIELD OF THE INVENTION

The present invention relates to liquid compositions for cleaning a variety of hard surfaces such as hard surfaces found in around the house, such as bathrooms, toilets, garages, driveways, basements, gardens, kitchens, etc. More specifically, the present invention relates to liquid scouring composition suitable for use in cleaning hard surfaces.

BACKGROUND OF THE INVENTION

Scouring compositions such as those particulate compositions or liquid, gel, paste-type compositions containing abrasive components are well known in the art. Such compositions are used for cleaning hard surfaces, especially those surfaces that tend to become soiled with difficult to remove stains and soils in for example the kitchen and/or bathroom environments.

Amongst the currently known scouring compositions, the most popular ones are based on abrasive particles with shapes varying from spherical to irregular. The most common abrasive particles are either inorganic like carbonate salt, clay, silica, silicate, shale ash, perlite and quartz sand or organic polymers beads like polypropylene, PVC, Melamine, polyacrylate and derivatives, and come in the form of liquid composition having a creamy consistency with the abrasive particles suspended therein.

The surface safety profile of such currently known scouring compositions is inadequate. Indeed, due to the presence of very hard abrasive particles, these compositions can damage, i.e., scratch, the hard surfaces onto which they have been applied. Indeed, the formulator needs to chose between good cleaning performances but featuring strong surface damage or compromising on the cleaning performances while featuring acceptable surface safety profile. Furthermore, in general high levels of abrasive particles are needed to reach good cleaning performance, thus leading to high formulation and process cost, difficult rinse and end cleaning profiles, as well as limitation for lotion aesthetics. In addition, such currently known scouring compositions are perceived by consumers as outdated.

The Applicant has found that a new generation of liquid scouring compositions can be based on melamine foam fibres. Indeed, such compositions deliver an excellent cleaning, i.e., solid and stains removal, performance on a variety of soils and stains, such as: food stains such as coffee and grease; marker pens; limescale; encrusted carbon or clay-based dusts, an the like. Furthermore, melamine foam fibres-based compositions have an improved surface safety profile as compared to current scouring compositions. Indeed, melamine foam fibres-based compositions do not or do to a reduced degree damage, i.e., scratch, hard surfaces to which they are applied. Furthermore, the use melamine foam fibres in liquid cleaning compositions provides a unique shape and size geometry both at microscopic level (i.e., very small and sharp fiber for efficient scrapping) and at macroscopic level (i.e., abrasive particles made of fibers connected to each other) Indeed, a part of the melamine foam fiber are present in the composition as larger particles made of a network of fine fibers delivering macroscopic cleaning while another part of the melamine foam fiber are present in the composition are present as the fine fibers providing microscopic cleaning.

However, it has been found that the stability of liquid compositions comprising melamine foam fibres can be improved by selecting a specific pH range at which such compositions are formulated. Indeed, it has been found that the melamine foam fibres in such liquid compositions may release formaldehyde into the liquid compositions at certain pH values, in particular upon storage of such compositions over a prolonged period of time. The presence of increased levels of formaldehyde in liquid cleaning compositions used in hard surface cleaning compositions, in particular hard surface cleaning compositions for use in domestic cleaning applications, is not desirable. Furthermore, in certain countries government safety standards regulate the permissible levels of formaldehyde in liquid cleaning compositions and prevent the sale of hard surface cleaning compositions comprising increased levels of formaldehyde.

It is thus an objective of the present invention to provide a liquid hard surface cleaning compositions comprising melamine foam fibres that maintain a low level of formaldehyde upon storage of such compositions even over a prolonged period of time or even liquid hard surface cleaning compositions comprising melamine foam fibres wherein substantially no formaldehyde is released upon storage of such compositions even over a prolonged period of time.

It has been found that the above objective can be met by the composition according to the present invention.

It is an advantage of the compositions according to the present invention that they may be used to clean hard surfaces made of a variety of materials like glazed and non-glazed ceramic tiles, enamel, stainless steel, Inox®, Formica®, vinyl, no-wax vinyl, linoleum, melamine, glass, plastics.

A further advantage of the present invention is that the compositions herein are safe to consumers and not damaging to the treated surface, especially delicate surface such as linoleum, glass, plastic or chromed surfaces.

SUMMARY OF THE INVENTION

The present invention relates to a liquid hard surface cleaning composition comprising melamine foam fibres, wherein said compositions has a pH of from about 7 to about 12.

The present invention further encompasses a liquid hard surface cleaning composition comprising melamine foam fibres, wherein said composition comprises less than about 200 ppm of formaldehyde in solution after about 7 days of storage at about 50° C.

The present invention further encompasses a process of cleaning a hard surface with a liquid hard surface cleaning composition comprising melamine foam fibres, wherein said compositions has a pH of from about 7 to about 12.

The present invention further encompasses the use of melamine foam fibres in a liquid hard surface cleaning composition, wherein said compositions has a pH of from about 7 to about 12, to provide liquid hard surface cleaning composition showing no or low levels of formaldehyde generation upon storage of said composition over prolonged periods of time.

DETAILED DESCRIPTION OF THE INVENTION

The Liquid Hard Surface Cleaning Composition

The compositions according to the present invention are designed as hard surfaces cleaners.

The compositions according to the present invention are liquid compositions as opposed to a solid or a gas.

The liquid neutral to alkaline, preferably alkaline, hard surface cleaning compositions according to the present invention are preferably aqueous compositions. Therefore, they may comprise from about 70% to about 99.5% by weight of the total composition of water, preferably from about 75% to about 95% and more preferably from about 80% to about 95%.

The compositions of the present invention have a pH from about 7 and about 12, more preferably from about 8 to about 11, even more preferably about 9 to about 10.

The pH of the cleaning compositions herein, as is measured at 25° C., is at least 7, with increasing preference in the order given, about 8, about 9, about 9.5. The pH of the cleaning compositions herein, as is measured at 25° C., is no more than about 12, preferably with increasing preference in the order given, about 11.5, about 11, about 10.5 or about 10.

Accordingly, the compositions herein may comprise a base to adjust the pH.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, all available carbonate salts such as $K_2CO_3$, $Na_2CO_3$, $Ca_2CO_3$, $Mg_2CO_3$, etc., alkanolamines (as e.g. monoethanolamine), urea and urea derivatives, polyamine, etc.

Typical levels of such bases, when present, are of from about 0.01% to about 5.0%, preferably from about 0.05% to about 3.0% and more preferably from about 0.1% to about 0.6% by weight of the total composition.

The compositions herein may comprise an acid to trim its pH to the required level, despite the presence of an acid, if any, the compositions herein will maintain their neutral to alkaline, preferably alkaline, pH as described herein above. A suitable acid for use herein is an organic and/or an inorganic acid. A preferred organic acid for use herein has a pKa of less than 6. A suitable organic acid is selected from the group consisting of citric acid, lactic acid, glycolic acid, succinic acid, glutaric acid and adipic acid and a mixture thereof. A mixture of said acids may be commercially available from BASF under the trade name Sokalan® DCS. A suitable inorganic acid is selected from the group consisting hydrochloric acid, sulphuric acid, phosphoric acid and a mixture thereof.

A typical level of such an acid, when present, is of from about 0.01% to about 5.0%, preferably from about 0.04% to about 3.0% and more preferably from about 0.05% to about 1.5% by weight of the total composition.

The Applicant has found that melamine foam fibres present in liquid compositions at certain pH values, in particular upon storage of such compositions over a prolonged period of time, may not be fully stable. Indeed, at a pH above about 12 and below about 7 and especially below about 5, melamine foam fibres present in a liquid composition release formaldehyde into said composition. The presence of increased levels of formaldehyde in liquid cleaning compositions used in hard surface cleaning compositions, in particular hard surface cleaning compositions for use in domestic cleaning applications, is not desirable. Furthermore, in certain countries government safety standards regulate the permissible levels of formaldehyde in liquid cleaning compositions and prevent the sale of hard surface cleaning compositions comprising increased levels of formaldehyde.

By "prolonged periods of storage" or "upon storage" it is meant herein a period of storage of 6 months at 25° C.

Prolonged periods of storage may be assessed in the laboratory using a rapid ageing test ("RAT"). The RAT involves storage of a composition for 7 days at 50° C. Under laboratory conditions, by "prolonged periods of storage", it is therefore to be understood 7 days of storage at 50° C.±0.5° C.

The Applicant has surprisingly found that by using a composition having a pH of about 7 to about 12, the pH of said composition is in an optimal range to achieve compositions wherein that the melamine foam fibres therein release formaldehyde at low levels or even show substantially no formaldehyde release, especially upon prolonged periods of storage.

Thus, the present invention further encompasses the use of melamine foam fibres in a liquid hard surface cleaning composition, wherein said compositions has a pH of from about 7 to about 12, to provide liquid hard surface cleaning composition showing no or low levels of formaldehyde generation upon storage of said composition over prolonged periods of time.

By "substantially no formaldehyde" it is meant herein less than about 50 ppm by weight of the composition of formaldehyde (preferably in solution).

The compositions according to the present invention typically comprise less than 200 ppm, preferably less than 100 ppm, more preferably less than 50 ppm, by weight of formaldehyde (preferably in solution), preferably per 1% by weight of melamine foam fibers present in the composition.

The compositions according to the present invention typically comprise less than about 200 ppm, preferably less than about 100 ppm, more preferably less than about 50 ppm, of formaldehyde (preferably in solution), preferably per about 1% by weight of melamine foam fibers present in the composition, upon storage (i.e., after 7 days of storage at 50° C.).

Thus, in a second independent embodiment of the present invention, the invention encompasses a liquid hard surface cleaning composition comprising melamine foam fibres, wherein said composition comprises less than about 200 ppm of formaldehyde in solution after about 7 days of storage at about 50° C. All features listed as either optional or essential for the first embodiment of the present invention are also optional features for the second independent embodiment of the present invention.

By "formaldehyde in solution" it is meant herein, formaldehyde that is solubilised in the liquid compositions as compared to formaldehyde that is part (i.e., chemically bound) of the melamine—formaldehyde resin forming the melamine foam fibers present in the liquid composition herein.

Any method known to those skilled in the art may be used to determine the amount or moles of free formaldehyde in a composition (i.e., formaldehyde in solution). Such methods include the EPA method EPA 8315A, Determination of Carbonyl Compounds by High Performance Liquid Chromatography (incorporated by reference herein), and High-Performance Liquid Chromatographic Determination of Free Formaldehyde in Cosmetics Preserved with Dowicil 200, *Journal of Chromatography,* 502 (1990), pages 193-200 (incorporated by reference herein).

Immediately prior to performing a free formaldehyde (formaldehyde in solution) determination using the below (or any) test method, any (e.g., suspended) particulate materials, such as melamine foam fibres, should be removed from the composition to be tested. Indeed, such removal can be done by filtration or any other suitable means, preferably it is done by filtration. Indeed, the presence of such particulate materials could lead to a faulty reading on formaldehyde in solution by including bound-formaldehyde such as present in the melamine-formaldehyde resin making up the melamine foam.

One suitable "free formaldehyde test method" is the following: free formaldehyde (i.e., formaldehyde in solution) is analyzed by means of room temperature (20° C.) derivatization with 2,4 dinitrophenyl hydrazine (DNPH) prior to a chromatographic separation using Reversed Phase Chromatography with UV/Visible spectrophotometric detection (wavelength setting at 365 nm). The calibration for the Reversed Phase Chromatography is performed through an "External Standard calibration" with a reference formaldehyde solution made up from commercially available 36-37% formaldehyde solution. The activity of the formaldehyde standard material can be determined via redox titration (back-titration of iodine with thiosulphate).

In a preferred embodiment according to the present invention the compositions herein are thickened compositions. Preferably, the liquid hard surface cleaning compositions herein have a viscosity of up to about 5000 cps at 20 $s^{-1}$, more preferably from about 50 cps to about 5000 cps, yet more preferably from about 50 cps to about 2000 cps and most preferably from about 50 cps to about 1200 cps at 20 $s^{-1}$ and 20° C. when measured with a Rheometer, model AR 1000 (Supplied by TA Instruments) with a 4 cm conic spindle in stainless steel, 2° angle (linear increment from 0.1 to 100 $sec^{-1}$ in max. 8 minutes). Preferably, the thickened compositions according to this specific embodiment are shear-thinning compositions. The preferred thickened liquid hard surface cleaning compositions herein preferably comprise a thickener, more preferably a polysaccharide polymer (as described herein below) as thickener, still more preferably a gum-type polysaccharide polymer thickener and most preferably Xanthan gum.

In another preferred embodiment according to the present invention the compositions herein have a water-like viscosity. By "water-like viscosity" it is meant herein a viscosity that is close to that of water. Preferably the liquid hard surface cleaning compositions herein have a viscosity of up to about 50 cps at 60 rpm, more preferably from about 0 cps to about 30 cps, yet more preferably from about 0 cps to about 20 cps and most preferably from about 0 cps to about 10 cps at 60 rpm and 20° C. when measured with a Brookfield digital viscometer model DV II, with spindle 2.

Melamine Foam Fibres

The compositions according to the present invention comprise melamine foam fibres. The compositions herein may comprise at least about 0.5%, preferably from about 0.5% to about 25%, more preferably from about 1% to about 10%, even more preferably from about 1% to about 4%, and most preferably from about 2% to about 4% by weight of the total composition of melamine foam fibres.

Melamine foam fibres are based on melamine foam. By "melamine foam" it is meant herein a melamine-formaldehyde resin foam.

A suitable melamine-formaldehyde resin foam raw material is commercially available under the trade name Basotect® from BASF.

The "melamine foam" described above can be prepared by blending major starting materials of melamine and formaldehyde, or a precursor thereof, with a blowing agent, a catalyst and an emulsifier, injecting the resultant mixture into a mold, and making the reaction mixture generate heat through a proper means such as heating or irradiation with electromagnetic wave to cause foaming and curing. The molar ratio of melamine to formaldehyde (i.e., melamine:formaldehyde) for producing the precursor is preferably about 1:1.5 to about 1:4, particularly preferably about 1:2 to about 1:3.5 in melamine:formaldehyde. In addition, number average molecular weight of the precursor is preferably about 200 to about 1,000, particularly preferably about 200 to about 400. Additionally, formalin, which is an aqueous solution of formaldehyde, is usually used as formaldehyde.

As monomers for producing the precursor, the following various monomers may be used in an amount of about 50 parts by weight (hereinafter abbreviated as "parts") or less, particularly about 20 parts by weight or less, per about 100 parts by weight of the sum of melamine and formaldehyde in addition to melamine and formaldehyde. As other monomers corresponding to melamine, there may be used C1-5 alkyl-substituted melamines such as methylolmelamine, methylmethylolmelamine and methylbutylolmelamine, urea, urethane, carbonic acid amides, dicyandiamide, guanidine, sulfurylamides, sulphonic acid amides, aliphatic amines, phenols and the derivatives thereof. As aldehydes, there may be used acetaldehyde, trimethylol acetaldehyde, acrolein, benzaldehyde, furfurol, glyoxal, phthalaldehyde, terephthalaldehyde, etc.

As the blowing agent, there may be used pentane, trichlorofluoromethane, trichlorotrifluoroethane, etc. However, use of so-called fleons® such as trichlorofluoromethane is regulated from the point of view of environmental problems, thus not being preferred. On the other hand, pentane is preferred in that it easily provides a foam when used even in a small amount but, since it has a volatile flammability, it requires sufficient care in its handling. Further, as the catalyst, formic acid is commonly used and, as the emulsifier, anionic surfactants such as sodium sulfonate may be used.

The amount of the electromagnetic wave to be irradiated for accelerating the curing reaction of the reaction mixtures is preferably adjusted to be about 500 to about 1,000 kW, particularly about 600 to about 800 kW, in electric power consumption based on 1 kg of an aqueous formaldehyde solution charged in the mold. In case when this electric power consumption is insufficient, there results an insufficient foaming, leading to production of a cured product with a high density. On the other hand, in case when the electric power consumption is excessive, the pressure upon foaming becomes seriously high, leading to serious exhaustion of the mold and even the possibility of explosion. Thus, electric power consumption outside the range is not preferred.

Melamine foam fibres may be obtained from melamine foam by any appropriate way know to those skilled in the art. One suitable way of obtaining melamine foam fibres from melamine foam is to grind melamine foam. Other suitable means include the use of eroding tools such as a high speed eroding wheel with dust collector wherein the surface of the wheel is engraved with a pattern or is coated with abrasive sandpaper or the like to promote the melamine foam to form fine dust. Another way of creating melamine foam fibres is to directly allow the melamine to be foamed as fibres or small particles thereof.

By "melamine foam fibres" it is meant herein single fibres of melamine foam and/or small particles of such fibres interlinked stemming from incomplete grinding or erosion thereof.

Melamine foam can be ground using commercially available equipment such as the Hosokawa Alpine Grinder.

An alternative way to obtain the melamine fiber is via extrusion. Indeed, commercial melamine foam fibers exist under the Basofil trade name from BASF.

In a preferred embodiment herein, wherein single melamine fibers are used, obtained, e.g., via extrusion, or extreme grinding/erosion of melamine foam, the preferred fiber diameter is below about 100 μm and fiber length below about 500 μm, more preferably fiber diameter below 30 μm and fiber length below about 250 μm and most preferably fiber diameter below 10 μm and fiber length below about 150 μm.

In an alternative preferred embodiment herein, wherein small particles of interlinked melamine foam fibres are used, the particle size of sais particles—as determined after sieving—is preferably below about 200 μm, more preferably below about 100 μm and most preferably from about 20-50 μm.

Optional Ingredients

The compositions according to the present invention may comprise a variety of optional ingredients depending on the technical benefit aimed for and the surface treated.

Suitable optional ingredients for use herein include suspending aids, formaldehyde scavengers, chelating agents, surfactants, radical scavengers, perfumes, surface-modifying polymers, solvents, builders, buffers, bactericides, hydrotropes, colorants, stabilizers, bleaches, bleach activators, suds controlling agents like fatty acids, enzymes, soil suspenders, brighteners, anti dusting agents, dispersants, pigments, and dyes.

Suspending Aid

The melamine foam fibres present in the composition herein are solid particles in a liquid composition. Such fibres may be suspended in the liquid composition. However, it is well within the scope of the present invention that such fibres are not-stably suspended within the composition and either settle or float on top of the composition. In this case, a user may have to temporally suspend the fibers by agitating (e.g., shaking or stirring) the composition prior to use.

However, it is preferred herein that the melamine foam fibres are stably suspended in the liquid compositions herein. As an optional ingredient, the compositions herein may thus comprise a suspending aid.

The suspending aid herein may either be a compound specifically chosen to provide a suspension of the melamine foam fibres in the liquid compositions of the present invention, such as a structurant, or a compound that also provides another function, such as a thickener or a surfactant (as described herein elsewhere).

Any suitable organic and inorganic suspending aids typically used as gelling, thickening or suspending agents in hard surface cleaning compositions and other detergent or cosmetic compositions may be used herein. Indeed, suitable organic suspending aids include polysaccharide polymers. In addition or as an alternative, polycarboxylate polymer thickeners may be used herein. Also, in addition or as an alternative of the above, layered silicate platelets e.g.: Hectorite, bentonite or montmorillonites can also be used.

Suitable commercially available layered silicates are Laponite RD® or Optigel CL® available from Rockwood Additives.

Suitable polycarboxylate polymer thickeners include (preferably lightly) crosslinked polyacrylate. A particularly suitable polycarboxylate polymer thickeners is Carbopol commercially available from Lubrizol under the trade name Carbopol 674®.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like Xanthan gum, gellan gum, guar gum, locust bean gum, tragacanth gum, Succinoglucan gum, or derivatives thereof, or mixtures thereof. Xanthan gum is commercially available from Kelco under the tradename Kelzan T.

Preferably the suspending aids herein is Xanthan gum. In an alternative embodiment, the suspending aid herein is a polycarboxylate polymer thickeners preferably a (preferably lightly) crosslinked polyacrylate. In a highly preferred embodiment herein, the liquid compositions comprise a combination of a polysaccharide polymer or a mixture thereof, preferably Xanthan gum, with a polycarboxylate polymer or a mixture thereof, preferably a crosslinked polyacrylate.

As a preferred example, Xanthan gum is preferably present at levels between about 0.1% to about 5%%, more preferably about 0.5% to about 2%, even more preferably about 0.8% to about 1.2%, by weight of the total composition.

Formaldehyde Scavengers

As an optional ingredient, the compositions herein may comprise a formaldehyde scavenger.

In addition to formulating the compositions herein at specific, preferred pH range, the addition of a formaldehyde scavenger may further reduce the presence of formaldehyde in solution upon storage or may substantially completely, preferably completely, prevent it. Indeed, the term "formaldehyde scavenger" is used herein in the broadest sense to include any compound known to those skilled in the art that reduces the level of formaldehyde in the compositions of the present invention, provided the formaldehyde scavenger is safe for humans.

In one embodiment, the formaldehyde scavenger is chosen from the group consisting of: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), poly(vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, and chitosan, and a mixture thereof. More preferably, the formaldehyde scavenger is chosen from: sodium bisulfite, urea, cysteine, lysine, glycine, serine, 3,4-diaminobenzoic acid, allantoin, glycouril, ethyl acetoacetate, acetoacetamide, malonamide, ascorbic acid, 1,3-dihydroxyacetone dimer, biuret, oxamide, benzoguanamine, pyroglutamic acid, succinamide, triazole, sulfanilic acid, oxamide, glucose, cellulose, poly(vinyl alcohol), poly (vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, dibutyl amine, hydroxycitronellol, dehydroacetic acid, chitosan, or a mixture thereof. Even more preferably, the formaldehyde scavenger is chosen from the group consisting of: sodium bisulfite, ethyl acetoacetate, acetoacetamide, ethylenediamine-N,N'-bisacetoacetamide, ascorbic acid, 2,2-dimethyl-1,3-dioxan-4,6-dione, helional, triplal, and lilial and a mixture thereof. Most preferably, the formaldehyde scavenger is chosen from the group consisting of sodium bisulfite, ethyl acetoacetate, acetoacetamide, ethylenediamine-N,N'-bisacetoacetamide, ascorbic acid, 2,2-dimethyl-1,3-dioxan-4,6-dione, helional, triplal, and lilial and mixtures thereof.

Preferred formaldehyde scavenger for use in liquid, alkaline compositions are Ammoniac (ammonium chloride), sodium hydroxide dicyanodiamide, acetoacetamide or organic polyamine, such as polyvinyl amine.

The above formaldehyde scavengers may be commercially obtained from Sigma/Aldrich/Fluka.

In the preferred embodiment, wherein sodium bisulphite is the formaldehyde scavenger herein, it is preferably used at excess molar concentrations of from about 1:1 to about 5:1, more preferably from about 2:1 to about 4:1, even more preferably from about 2:1 to about 5:2, relative to the potential amount of free formaldehyde in the composition.

In the preferred embodiment, wherein a β-ketoesters or a β-ketoamide are the formaldehyde scavenger herein, they preferably used at excess molar concentrations of from about 15:1 to about 2.5:1, more preferably about 10:1 to about 2.5:1, even more preferably about 5:1 to about 2.5:1 relative to the potential amount of free formaldehyde in the composition.

In one preferred embodiment herein, the ketoester or ketoamide is chosen from a β-ketoester or a β-ketoamide, respectively. Non-limiting examples include acetoacetamide or ethyl acetoacetate (available from Aldrich). Another example includes 16-diketene sizing agents (the diketene can ring open with any alcohol to yield a ketoester) such as those available from Hercules.

In the preferred embodiment, wherein ethyl acetoacetate is the formaldehyde scavenger herein, it is preferably used at excess molar concentrations of from 10:1 to 3:1, more preferably from 5:1 to 3:1 relative to the potential amount of free formaldehyde in the composition.

By "the potential amount of free formaldehyde in the composition" it is meant herein the theoretical total amount of formaldehyde in solution originating from the melamine foam fibres. Typically, the potential amount of free formaldehyde in the composition is 5-25% (preferably 5%) by weight of the total melamine foam fibres present in said composition.

Preferably, the composition herein comprises from about 0.01% to about 5%, preferably from about 0.1% to about 2%, more preferably from about 0.2% to about 0.8%, by weight of the liquid composition of said formaldehyde scavenger.

Preferably, the composition herein comprises said formaldehyde scavenger at a weight ratio of formaldehyde scavenger to melamine foam fibres of about 1:5 to about 5:1, more preferably of about 1:2 to about 2:1, and even more preferably of about 1:1.5 to about 1.5:1, and most preferably about 1:1.

Surfactants

The compositions herein may comprise a nonionic, anionic, zwitterionic and amphoteric surfactant or mixtures thereof. Said surfactant is preferably present at a level of from about 0.01% to about 20% of composition herein. Suitable surfactants are those selected from the group consisting of nonionic, anionic, zwitterionic and amphoteric surfactants, having hydrophobic chains containing from about 8 to about 18 carbon atoms. Examples of suitable surfactants are described in McCutcheon's Vol. 1: Emulsifiers and Detergents, North American Ed., McCutcheon Division, MC Publishing Co., 2002 (incorporated by reference herein).

Preferably, the hard surface cleaning composition herein comprises from about 0.01% to about 20%, more preferably from about 0.5% to about 10%, and most preferably from about 1% to about 5% by weight of the total composition of a surfactant or a mixture thereof.

Non-ionic surfactants are highly preferred for use in the compositions of the present invention. Non-limiting examples of suitable non-ionic surfactants include alcohol alkoxylates, alkyl polysaccharides, amine oxides, block copolymers of ethylene oxide and propylene oxide, fluoro surfactants and silicon based surfactants. Preferably, the aqueous compositions comprise from about 0.01% to about 20%, more preferably from about 0.5% to about 10%, and most preferably from about 1% to about 5% by weight of the total composition of a non-ionic surfactant or a mixture thereof.

A preferred class of non-ionic surfactants suitable for the present invention is alkyl ethoxylates. The alkyl ethoxylates of the present invention are either linear or branched, and contain from about 8 carbon atoms to about 16 carbon atoms in the hydrophobic tail, and from about 3 ethylene oxide units to about 25 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred alkyl ethoxylates comprise from about 9 to about 12 carbon atoms in the hydrophobic tail, and from about 4 to about 9 oxide units in the hydrophilic head group. A most preferred alkyl ethoxylate is $C_{9-11}EO_5$, available from the Shell Chemical Company under the tradename Neodol 91-5®. Non-ionic ethoxylates can also be derived from branched alcohols. For example, alcohols can be made from branched olefin feedstocks such as propylene or butylene. In a preferred embodiment, the branched alcohol is either a 2-propyl-1-heptyl alcohol or 2-butyl-1-octyl alcohol. A desirable branched alcohol ethoxylate is 2-propyl-1-heptyl EO7/AO7, manufactured and sold by BASF Corporation under the tradename Lutensol XP 79/XL 79®.

Another class of non-ionic surfactant suitable for the present invention is alkyl polysaccharides. Such surfactants are disclosed in U.S. Pat. Nos. 4,565,647, 5,776,872, 5,883,062, and 5,906,973 (all of which are incorporated by reference herein). Among alkyl polysaccharides, alkyl polyglycosides comprising five and/or six carbon sugar rings are preferred, those comprising six carbon sugar rings are more preferred, and those wherein the six carbon sugar ring is derived from glucose, i.e., alkyl polyglucosides ("APG"), are most preferred. The alkyl substituent in the APG chain length is preferably a saturated or unsaturated alkyl moiety containing from about 8 to about 16 carbon atoms, with an average chain length of about 10 carbon atoms. $C_8$-$C_{16}$ alkyl polyglucosides are commercially available from several suppliers (e.g., Simusol® surfactants from Seppic Corporation, 75 Quai d'Orsay, 75321 Paris, Cedex 7, France, and Glucopon 220®, Glucopon 225®, Glucopon 425®, Plantaren 2000 N®, and Plantaren 2000 N UP®, from Cognis Corporation, Postfach 13 01 64, D 40551, Dusseldorf, Germany).

Another class of non-ionic surfactant suitable for the present invention is amine oxide. Amine oxides, particularly those comprising from about 10 carbon atoms to about 16 carbon atoms in the hydrophobic tail, are beneficial because of their strong cleaning profile and effectiveness even at levels below about 0.10%. Additionally $C_{10-16}$ amine oxides, especially $C_{12}$-$C_{14}$ amine oxides are excellent solubilizers of perfume. Alternative non-ionic detergent surfactants for use herein are alkoxylated alcohols generally comprising from about 8 to about 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cédex, France) and under the tradename Nonidet® available from Shell Chemical.

The condensation products of ethylene oxide with a hydrophobic base formed by the condensation of propylene oxide with propylene glycol are also suitable for use herein. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein x, y, and z are from about 1 to about 100, preferably about 3 to about 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF.

Other suitable though not preferred non-ionic surfactants include the polyethylene oxide condensates of alkyl phenols, e.g., the condensation products of alkyl phenols having an alkyl group containing from about 6 to about 12 carbon atoms in either a straight chain or branched chain configuration, with ethylene oxide, the said ethylene oxide being present in amounts equal to about 5 to about 25 moles of ethylene oxide per mole of alkyl phenol. The alkyl substituent in such compounds can be derived from oligomerized propylene, diisobutylene, or from other sources of iso-octane n-octane, iso-nonane or n-nonane. Other non-ionic surfactants that can be used include those derived from natural sources such as sugars and include $C_8$-$C_{16}$ N-alkyl glucose amide surfactants.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C_6$-$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is an about $C_6$-$C_{20}$ linear or branched, saturated or unsaturated alkyl group, preferably an about $C_8$-$C_{18}$ alkyl group and more preferably an about $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by an about $C_6$-$C_{20}$ linear or branched saturated or unsaturated alkyl group, preferably an about $C_8$-$C_{18}$ alkyl group and more preferably an about $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

An example of an about $C_{14}$-$C_{16}$ alkyl sulphonate is Hostapur® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from about 6 to about 20 carbon atoms and alkyl phenyl radicals containing from about 6 to about 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly preferred branched alkyl sulphates to be used herein are those containing from about 10 to about 14 total carbon atoms like Isalchem 123 AS®. Isalchem 123 AS® commercially available from Enichem is a $C_{12-13}$ surfactant which is 94% branched. This material can be described as $CH_3$—$(CH_2)_m$—$CH(CH_2OSO_3Na)$—$(CH_2)_n$—$CH_3$ where n+m=8-9. Also preferred alkyl sulphates are the alkyl sulphates where the alkyl chain comprises a total of about 12 carbon atoms, i.e., sodium 2-butyl octyl sulphate. Such alkyl sulphate is commercially available from Condea under the trade name Isofol® 12S. Particularly suitable liner alkyl sulphonates include $C_{12}$-$C_{16}$ paraffin sulphonate like Hostapur® SAS commercially available from Hoechst.

Suitable alkyl alkoxylated sulphate surfactants for use herein are according to the formula $RO(A)_mSO_3M$ wherein R is an unsubstituted about $C_6$-$C_{20}$ alkyl or hydroxyalkyl group having an about $C_6$-$C_{20}$ alkyl component, preferably an about $C_{12}$-$C_{20}$ alkyl or hydroxyalkyl, more preferably about $C_{12}$-$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}$E(1.0)SM), $C_{12}$-$C_{18}$ alkyl polyethoxylate (2.25) sulfate ($C_{12}$-$C_{18}$E(2.25)SM), $C_{12}$-$C_{18}$ alkyl polyethoxylate (3.0) sulfate ($C_{12}$-$C_{18}$E(3.0)SM), and $C_{12}$-$C_{18}$ alkyl polyethoxylate (4.0) sulfate ($C_{12}$-$C_{18}$E(4.0)SM), wherein M is conveniently selected from sodium and potassium.

Suitable $C_6$-$C_{20}$ alkyl alkoxylated linear or branched diphenyl oxide disulphonate surfactants for use herein are according to the following formula:

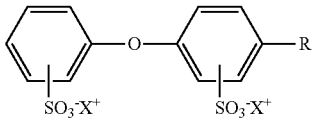

wherein R is an about $C_6$-$C_{20}$ linear or branched, saturated or unsaturated alkyl group, preferably an about $C_{12}$-$C_{18}$ alkyl group and more preferably an about $C_{14}$-$C_{16}$ alkyl group, and X+ is H or a cation, e.g., an alkali metal cation (e.g., sodium, potassium, lithium, calcium, magnesium and the like). Particularly suitable $C_6$-$C_{20}$ alkyl alkoxylated linear or branched diphenyl oxide disulphonate surfactants to be used herein are the C12 branched diphenyl oxide disulphonic acid and C16 linear diphenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$-$C_{24}$ olefinsulfonates, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO\text{-}M^+$ wherein R is an about $C_8$-$C_{22}$ alkyl, k is an integer from about 0 to about 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch—incorporated by reference herein). A variety of such surfactants are also generally disclosed in U.S. Pat. No. 3,929,678, issued Dec. 30, 1975 to Laughlin, et al. at Column 23, line 58 through Column 29, line 23 (incorporated by reference herein).

Zwitterionic surfactants represent another class of preferred surfactants within the context of the present invention.

Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082 (all of which are incorporated by reference herein).

A specific example of a zwitterionic surfactant is 3-(N-dodecyl-N,N-dimethyl)-2-hydroxypropane-1-sulfonate (Lauryl hydroxyl sultaine) available from the McIntyre Company (24601 Governors Highway, University Park, Ill. 60466, USA) under the tradename Mackam LHS®. Another specific zwitterionic surfactant is $C_{12-14}$ acylamidopropylene (hydroxypropylene) sulfobetaine that is available from McIntyre under the tradename Mackam 50-SB®. Other very useful zwitterionic surfactants include hydrocarbyl, e.g., fatty alkylene betaines. A highly preferred zwitterionic surfactant is Empigen BB®, a coco dimethyl betaine produced by Albright & Wilson. Another equally preferred zwitterionic surfactant is Mackam 35HP®, a coco amido propyl betaine produced by McIntyre.

Another class of preferred surfactants comprises the group consisting of amphoteric surfactants. One suitable amphoteric surfactant is a $C_8$-$C_{16}$ amido alkylene glycinate surfactant ('ampho glycinate'). Another suitable amphoteric surfactant is a $C_8$-$C_{16}$ amido alkylene propionate surfactant ('ampho propionate'). Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072 (incorporated by reference herein), N-higher alkylaspartic acids such as those produced according to the teaching of U.S. Pat. No. 2,438,091 (incorporated by reference herein), and the products sold under the trade name "Miranol®", and described in U.S. Pat. No. 2,528,378 (incorporated by reference herein).

Chelating Agents

One class of optional compounds for use herein includes chelating agents or mixtures thereof. Chelating agents can be incorporated in the compositions herein in amounts ranging from about 0.0% to about 10.0% by weight of the total composition, preferably about 0.01% to about 5.0%.

Suitable phosphonate chelating agents for use herein may include alkali metal ethane 1-hydroxy diphosphonates (HEDP), alkylene poly(alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. (incorporated by reference herein). Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins (incorporated by reference herein). Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents for use herein include salicylic acid, aspartic acid, glutamic acid, glycine, malonic acid or mixtures thereof.

Radical Scavenger

The compositions of the present invention may further comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl)butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers, when used, may be typically present herein in amounts up to 1 about 0% by weight of the total composition and preferably from about 0.001% to about 0.5% by weight. The presence of radical scavengers may contribute to the chemical stability of the compositions of the present invention.

Perfume

Suitable perfume compounds and compositions for use herein are for example those described in EP-A-0 957 156 under the paragraph entitled "Perfume", on page 13 (incorporated by reference herein). The compositions herein may comprise a perfume ingredient, or mixtures thereof, in amounts up to about 5.0% by weight of the total composition, preferably in amounts of about 0.1% to about 1.5%.

Solvent

The compositions of the present invention may further comprise a solvent or a mixture thereof, as an optional ingredient. Solvents to be used herein include all those known to those skilled in the art of hard-surfaces cleaner compositions. In a highly preferred embodiment, the compositions herein comprise an alkoxylated glycol ether (such as n-Butoxy Propoxy Propanol (n-BPP)) or a mixture thereof.

Typically, the compositions of the present invention may comprise from about 0.1% to about 5% by weight of the total composition of a solvent or mixtures thereof, preferably from about 0.5% to about 5% by weight of the total composition and more preferably from about 1% to about 3% by weight of the total composition.

Dye

The liquid compositions according to the present invention may be coloured. Accordingly, they may comprise a dye or a mixture thereof. Suitable dyes for use herein are alkalinity-stable dyes. By "alkalinity-stable", it is meant herein a compound which is chemically and physically stable in the alkaline environment of the compositions herein.

Packaging Form of the Compositions

The compositions herein may be packaged in a variety of suitable detergent packaging known to those skilled in the art, such as plastic bottles for pouring liquid compositions or bottles equipped with a trigger sprayer for spraying liquid compositions. The liquid compositions are preferably packaged in conventional plastic bottles.

The liquid hard surface cleaning compositions (of all embodiments described herein) herein are preferably packaged in a container. The present invention thus also encompasses a container containing a liquid hard surface cleaning composition according to the present invention.

In a preferred embodiment herein, the liquid hard surface cleaning compositions (of all embodiments described herein) are packaged in a container, preferably a bottle, having a porous flexible sponge-type material, preferably having pores size dimensions allowing passage of the melamine foam fibers through it, mounted in the container aperture (sponge cap).

The Process of Cleaning a Hard Surface

The present invention encompasses a process of cleaning a hard surface with a liquid hard surface cleaning composition according to the present invention. In a preferred embodiment, the process of cleaning a hard surface herein involves the use of the hard surface cleaning compositions according to the present invention in either in neat or diluted form (see herein below). In a highly preferred embodiment herein, the compositions according to the present invention in neat form.

In a preferred embodiment said hard surface is contacted with the hard surface cleaning composition according to the present invention.

In another preferred embodiment, the process of cleaning a hard surface herein comprises the steps of dispensing (e.g., by spraying, pouring, squeezing) the liquid hard surface cleaning composition according to the present invention from a container containing said liquid hard surface cleaning composition and thereafter cleaning said hard surface.

By "hard surface", it is meant herein any kind of surface typically found in houses like kitchens, bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox®, Formica®, any plastics, plastified wood, metal or any painted or varnished or sealed surface and the like. Hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

Furthermore, hard surfaces herein also include hard surfaces of cars and other automotive vehicles.

In a preferred embodiment according to the present invention, the hard surface to be cleaned in the process herein is selected from the group consisting of ceramic, glass, enamel, stainless steel, chromed surfaces and Formica®. Preferably, the hard surface to be cleaned in the process herein is selected from the group consisting of bathroom hard surfaces preferably selected from the group consisting of: ceramic, glass, enamel, stainless steel and chromed surfaces.

In a preferred embodiment of the present invention said hard surface is inclined or vertical. Inclined or vertical hard surfaces include mirrors, lavatory pans, urinals, drains, side wall of bathtubs and shower stalls, waste pipes and the like. Such vertical or inclined surfaces can often be found in bathrooms.

A preferred embodiment of the present invention provides that a liquid hard surface cleaning composition is applied onto the surface to be treated. The composition may be in its neat form or in its diluted form.

By "in its neat form", it is to be understood that said liquid composition is applied directly onto the surface to be treated without undergoing any dilution, i.e., the liquid composition herein is applied onto the hard surface as described herein.

By "diluted form", it is meant herein that said liquid composition is diluted by the user typically with water. The liquid composition is diluted prior to use to a typical dilution level of up to 10 times its weight of water. A usually recommended dilution level is a 10% dilution of the composition in water.

In the process herein, the hard surface cleaning composition herein is applied onto said surface by conventional means known by the skilled person. Indeed, the composition herein may be applied by pouring or spraying said composition onto said surface.

In a highly preferred embodiment of the present invention the liquid hard surface cleaning composition herein is applied in its neat form onto said hard surface.

The hard surface cleaning composition herein may be applied using an appropriate implement, such as a mop, paper towel or a cloth, soaked in the diluted or neat composition herein. Furthermore, once applied onto said surface said composition may be agitated over said surface using an appropriate implement. Indeed, said surface may be wiped using a mop, paper towel or a cloth.

The process herein may additionally contain a rinsing step, preferably after the application of said composition. By "rinsing", it is meant herein contacting the hard surface cleaned with the process according to the present invention with substantial quantities of appropriate solvent, typically water, directly after the step of applying the liquid composition herein onto said hard surface. By "substantial quantities", it is meant herein between about 0.01 lt. and about 1 lt. of water per $m^2$ of hard surface, more preferably between about 0.1 lt. and about 1 lt. of water per $m^2$ of hard surface.

The hard surfaces to be treated may be soiled with a variety of soils, e.g., greasy soils (e.g., greasy soap scum, body grease, kitchen grease or burnt/sticky food residues typically found in a kitchen and the like), particulate greasy soils or so called "limescale-containing stains". By "limescale-containing stains" it is meant herein any pure limescale stains, i.e., any stains composed essentially of mineral deposits, as well as limescale-containing stains, i.e., stains which contain not only mineral deposits like calcium and/or magnesium carbonate but also soap scum (e.g., calcium stearate) and other grease (e.g. body grease).

EXAMPLES

These following compositions were made comprising the listed ingredients in the listed proportions (weight %). Examples I-V herein are met to exemplify the present invention but are not necessarily used to limit or otherwise define the scope of the present invention. Example A is a comparative example. Examples A and I-V have been tested for their formaldehyde release upon storage (1 and 2 weeks at 50° C.) using the above detailed free formaldehyde test method.

| Composition | A | I | II | III | IV | V |
|---|---|---|---|---|---|---|
| Melamine foam fibres | 1.0 | 1.0 | 1.0 | 1.0 | 2.0 | 2.0 |
| Lutensol XL80 ® | 5.0 | 5.0 | — | 5.0 | — | — |
| Kelzan T | — | 1.0 | — | — | — | — |
| Carbopol 674 ® | 1.0 | — | — | 1.0 | — | — |
| HCl | 1.0 | — | — | 1.0 | — | — |
| Urea | — | — | — | — | — | 5.0 |
| Acetoacetamide | — | — | — | — | 0.13 | — |

-continued

| Composition | A | I | II | III | IV | V |
|---|---|---|---|---|---|---|
| NaHCO3 | — | — | — | — | 1.0 | — |
| $NH_4OH$ | — | — | — | 0.5 | — | — |
| NaOH | 0.25 | 0.25 | 0.25 | — | — | — |
| Water | | | up to 100% | | | |
| pH | 6.8 | 11.56 | 11.71 | 9.79 | 9.29 | 9.05 |
| Formaldehyde level [ppm]: | | | | | | |
| after 1 week at 50° C. | 372.6 | 13.1 | 48.1 | 14.3 | n.a. | n.a. |
| after 2 weeks at 50° C. | 408.7 | 13.3 | 58.1 | 14.3 | 115.1 | 187.5 |

Melamine foam fibres were obtained by grinding Basotect ® melamine foam from BASF.
Lutensol XL80 ® is an alkyl polyethylene glycol ethers made from a C10 Guerbet alcohol and alkylene oxide (Degree of ethoxylation: 8) nonionic surfactant from BASF.
Kelzan T is clarified Xanthan gum from Kelco.
Carbopol 674 ® polymer is a lightly crosslinked polyacrylic acid polymer from Lubrizol.

Examples compositions I-V show excellent hard surfaces cleaning performance on kitchen and bathroom hard surfaces soiled with difficult to remove stains and soils.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid hard surface cleaning composition comprising small particles of interlinked melamine foam fibres having a particle size between about 20 μm and about 50 μm, wherein said compositions has a pH of from about 7 to about 12 and comprises from about 70% to about 99.5% by weight of the total composition of water, said composition further comprising from about 0.01% to about 5.0% of an organic acid.

2. A liquid hard surface cleaning composition according to claim 1, wherein said composition is packaged in a container.

3. A liquid hard surface cleaning composition according to claim 1, wherein said composition has a pH from about 8 to about 11, even more preferably about 9 to about 10.

4. A liquid hard surface cleaning composition according to claim 1, wherein said composition comprises at least about 0.5%, by weight of the total composition, of melamine foam fibres.

5. A liquid hard surface cleaning composition according to claim 1, wherein said composition comprises a suspending aid or a mixture thereof.

6. A liquid hard surface cleaning composition according to claim 1, wherein said composition comprises a formaldehyde scavenger, preferably selected from the group consisting of sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), poly(vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl- 1,3-cyclohexanedione , 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, and chitosan, and a mixture thereof.

7. A liquid hard surface cleaning composition according to claim 1, wherein said composition has an alkaline pH and comprises a formaldehyde scavenger selected from the group consisting of Ammoniac (ammonium chloride), sodium hydroxide dicyanodiamide, acetoacetamide and organic polyamine, such as polyvinyl amine, and mixtures thereof.

8. A liquid hard surface cleaning composition according to claim 1, wherein said composition comprises less than about 200 ppm, of formaldehyde in solution, preferably per about 1% by weight of melamine foam fibers present in said composition.

9. A liquid hard surface cleaning composition according to claim 1, wherein said composition comprises less than about 200 ppm of formaldehyde in solution, per about 1% by weight of melamine foam fibers present in said composition, upon storage.

10. A liquid hard surface cleaning composition comprising small particles of interlinked melamine foam fibres having a particle size between about 20 μm and about 50 μm, wherein said composition comprises less than about 200 ppm of formaldehyde in solution, per about 1% by weight of melamine foam fibers present in said composition, after 7 days of storage at 50 C, further wherein said composition comprises from about 70% to about 99.5% by weight of the total composition of water and from about 0.01% to about 5.0% of an organic acid.

11. A liquid hard surface cleaning composition according to claim 10, wherein said composition is packaged in a container.

12. A liquid hard surface cleaning composition according to claim 10, wherein said composition has a pH of about 7 to about 12.

13. A method of providing liquid hard surface cleaning composition showing no or low levels of formaldehyde generation upon storage of said composition over prolonged periods of time by incorporating small particles of interlinked melamine foam fibres in a liquid hard surface cleaning composition, wherein said compositions has a pH of from about 7 to about 12 and comprises from about 70% to about 99.5% by weight of the total composition of water, wherein said small particles of interlinked melamine foam fibres have a particle size between about 20 μm and about 50 μm, said composition further comprising from about 0.01% to about 5.0% of an organic acid.

* * * * *